United States Patent [19]

Grant

[11] Patent Number: 4,853,983

[45] Date of Patent: Aug. 8, 1989

[54] MECHANIZED TOILET SEAT

[76] Inventor: Denis A. Grant, Glasvey House, Ballykelly, Londonderry, Northern Ireland

[21] Appl. No.: 92,211

[22] Filed: Sep. 2, 1987

[51] Int. Cl.[4] ..... A47K 13/10

[52] U.S. Cl. ..... 4/251

[58] Field of Search ..... 4/251; 92/37, 39

[56] References Cited

U.S. PATENT DOCUMENTS

| | | | |
|---|---|---|---|
| 2,298,150 | 10/1942 | Newton | 92/39 X |
| 2,340,008 | 1/1944 | Matuszak | 92/37 X |
| 2,842,779 | 7/1958 | Zulkoski | 4/251 |
| 3,040,714 | 6/1962 | Taiclet | 92/37 X |
| 3,404,411 | 10/1968 | Newkirk | 4/251 |
| 3,945,565 | 3/1976 | Lynch et al. | 92/39 X |
| 4,291,422 | 9/1981 | Shoemaker | 4/251 |
| 4,426,743 | 1/1984 | Seabrooke | 4/251 |
| 4,577,350 | 3/1986 | Clark | 4/251 |

*Primary Examiner*—Lenard A. Footland
*Attorney, Agent, or Firm*—Brumbaugh, Graves, Donohue & Raymond

[57] ABSTRACT

A mechanized toilet seat and lid has a pair of quadrant shaped housings fitted, one on each side, to the toilet bowl with each housing containing a moveable lever which is directly connected to the separate hinge shafts of the toilet seat and lid. The levers which are used to lift or lower the toilet seat and lid are moved within the housings by inflation of a pair of pleated rubber bags, one of which is used for lifting and the other for returning the seat and lid to the rest position on the toilet bowl. Wooden or plastic seats can be used with the system and the lever movement of the mechanism can be further employed to operate the flushing mechanism of the cistern and the taps of wash basins. Foot bellows are used to activate the pleated air bags.

12 Claims, 5 Drawing Sheets

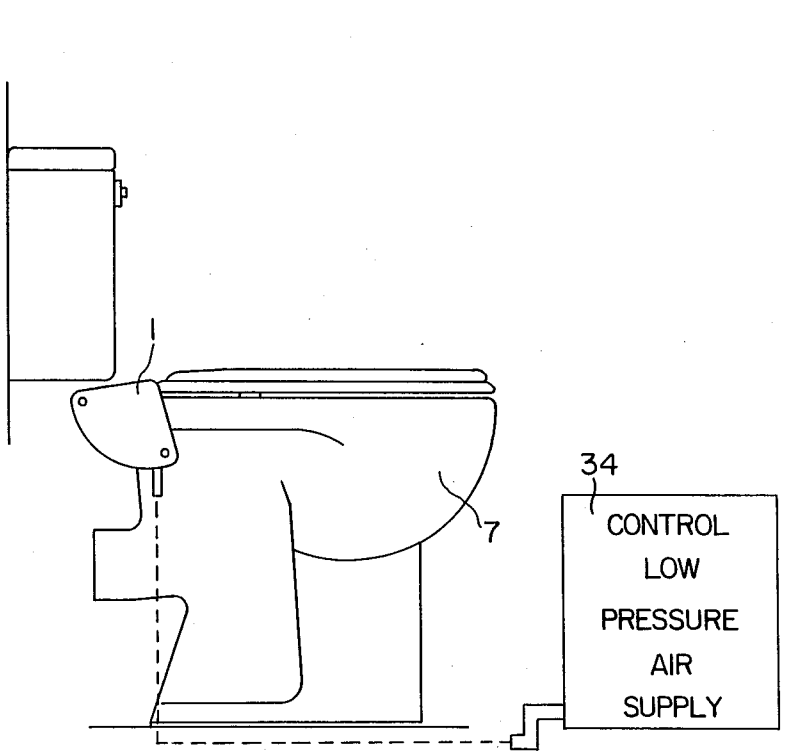
FIG. IB
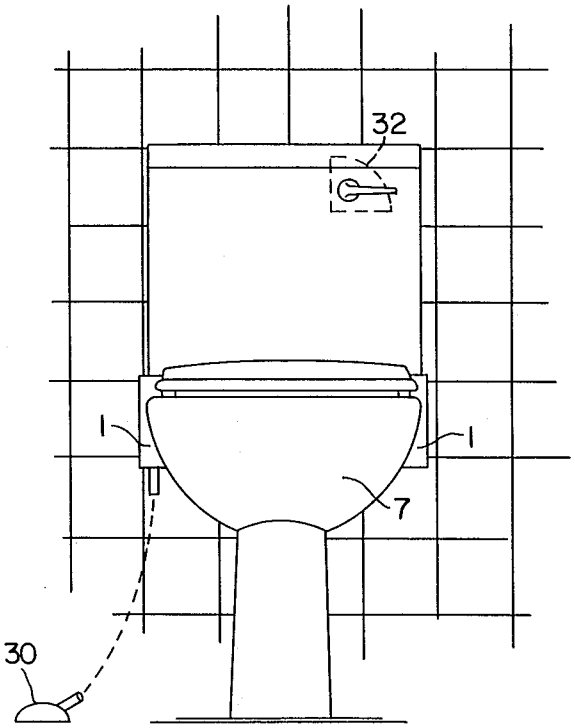
FIG. IA

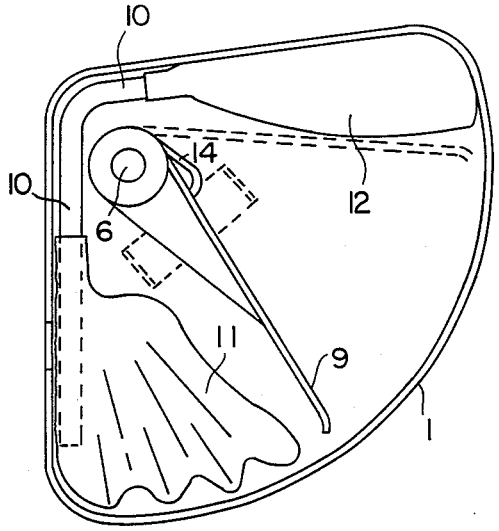
FIG. 3
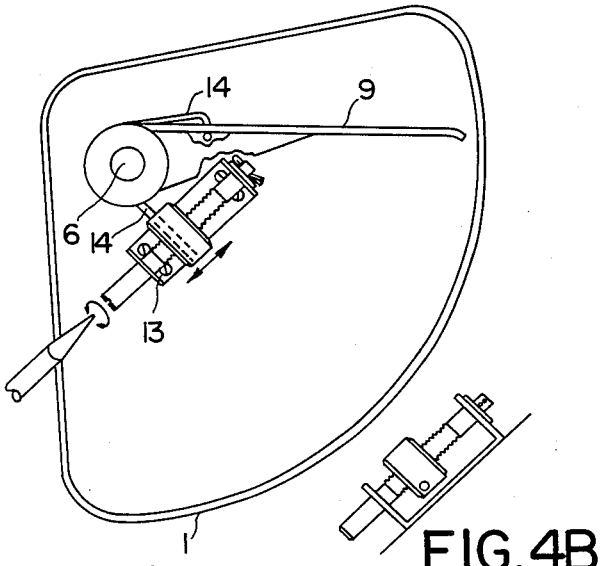
FIG.4A
FIG.4B

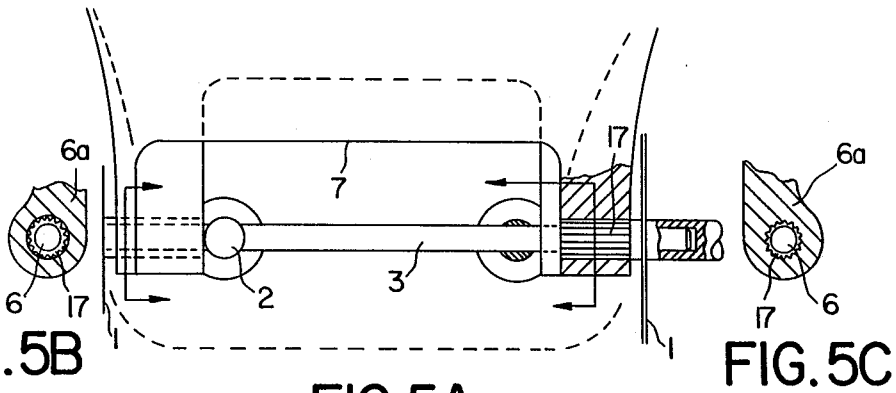
FIG. 5C
FIG. 5A
FIG. 5B
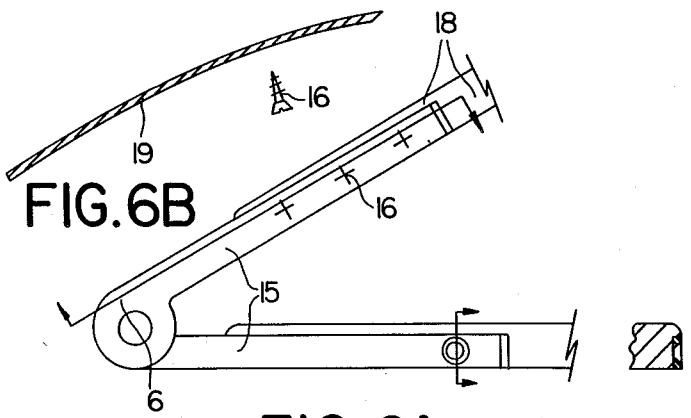
FIG. 6B
FIG. 6A

MECHANIZED TOILET SEAT

This invention relates to a toilet seat, with or without a hinged lid, which can be elevated into a generally vertical position by one mechanical action, and back into a generally horizontal rest position by another.

Toilet seats, especially those used in a communal situation, are often regarded by the majority of users as objects which are suspect from the bacteriological point of view. As a result of this aversion, male users of communal toilets do not regularly lift the seal into the vertical position before urination, and as a consequence of this inaction there frequently occurs a degree of contamination of the seat which supplies the nutrients for subsequent bacterial growth.

The present invention provides a mechanised toilet seat which is movable between rest positions in both the horizontal and vertical planes without the necessity for the user to touch any of the moving parts, including the lid.

According to the present invention there is provided a mechanised toilet seat or lid mechanism operable to move a toilet seat or lid between raised and lowered positions, comprising a housing within which is disposed an actuating lever connected to a hinge adapted to carry the seat or lid; a first inflatable bag disposed within the housing and operable to act on the actuating lever to cause it to rotate the seat or lid in one direction; and a second inflatable bag also disposed within the housing and operable to act on the actuating lever to cause it to rotate the seat or lid in the other direction; and means for supplying fluid under pressure to said bags thereby to inflate the bag and cause the seat and lid to be raised or lowered.

The invention may further comprise an additional actuating lever for connection to the flushing mechanism for the toilet; an inflatable bag operable to act on the lever to actuate the flushing mechanism; and means for supplying fluid under pressure to said bag, whereby the impulses in the pneumatic system can be further used to flush the water which has been stored in the cistern.

A specific embodiment of the invention will now be described by way of example with reference to the accompanying drawings in which:

FIG. 1 shows, in front and side elevations, a toilet bowl fitted with housing in the form of quadrant boxes which carry the pneumatic mechanism which activate the toilet seat and its lid;

FIG. 3 shows the actuator lever within the quadrant box with the outlines of the large and small rubber air bags;

FIG. 4 shows the counterbalancing weight of the seat and lid system of the toilet bowl and how adjustment thereof is accomplished by means of a screwdriver inserted into a spring tensioner;

FIG. 5 shows how the pneumatics of the quadrant boxes can be connected into the axle of a conventional all-plastic toilet seat and lid;

FIG. 6 shows a version of metal hinge which is preferable for use with the sturdy wooden seats and lid of communal toilet bowl;

Figure 2:
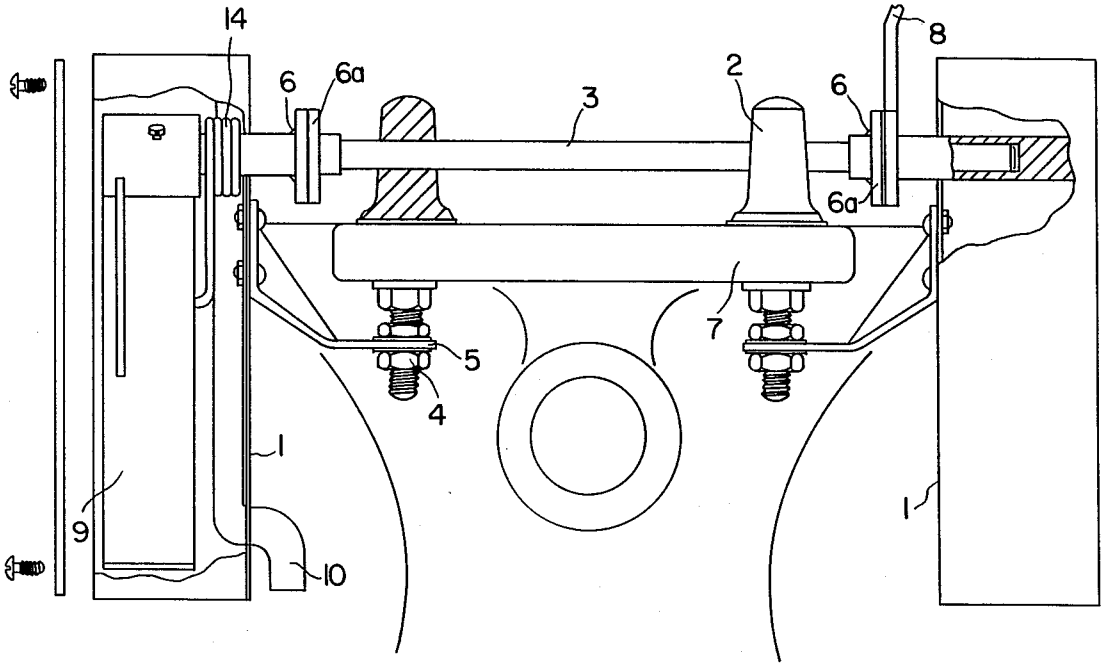
FIG. 2 illustrates the mechanical connections between the pneumatic mechanism in the quadrant boxes and the axle system of the toilet seat and lid.

Referring to the drawings, the mechanised toilet seat comprises one, or two housings in the form of, quadrant boxes 1 which are attached to a toilet bowl 7 by means of a pair of brackets 5 which are secured to the seat shaft bosses 2 with nuts 4 which engage the threaded studs of the bosses.

In FIG. 2 a common shaft 3 is provided wih axle sleeves 6 at each end which are associated externally with the hinge movements of the toilet seat and lid respectively and internally with levers 9 disposed within the quadrant boxes 1. When the sleeves 6 are welded, as shown, to the hinges 6a of the seat and lid then the movement of the levers 9 in the quadrant boxes 1 is capable, when suitably counterbalanced, of lifting the lid and seat by either one, or two operations as desired. By way of further illustration the position of the seat, or lid, is shown upright at 8.

FIG. 3 shows a side elevation of the quadrant box 1, with the cover removed, showing the pneumatic mechanism which freely moves the toilet seat, or lid, because the effort required has been greatly reduced by a counterbalancing action of the spring 14 which has been suitably tensioned by means of the adjustor 13. From the energy point of view the pneumatic medium is air which is fed to the quadrants by means of tubes 10 (FIG. 2) and acts upon the lever 9 by expanding the pleated rubber bags 11 and 12. The inflation of bag 11 moves the lever past the dotted position near bag 12 to raise the seat or lid and the inflation of bag 12 acts to push the lever back to its original position and return the seat, or lid, to the rest position on the toilet bowl. In this illustration it is important to note that the metal air tube 10 penetrates well into the bag 11 in order to act as a rigid support for the bag along the straight wall of the quadrant box 1.

FIG. 4 shows how the weight of the toilet seat or lid, on axle sleeves 6 is counterbalanced by means of the spring 14 the tension of which in practice, depending upon the weight of the seat used, can be finely adjusted by movement of screw device 13. By this spring means 14 the effort required to move the lever 9 is reduced to the minimum thus reducing the air pressure required to sufficiently inflate the bags 11 and 12 to render the mechanism operative.

By way of further utility for the invention there is illustrated at FIG. 5 a means by which the mechanism can be attached to the now more common plastic toilet seat and lid. The principle is the same as in the previous descriptions for the wooden seat except that the sleeves 6 which rotate on the shaft 3 and which were welded on the hinges 6a of the wooden seat and lid are instead serrated at 17 and fit into similar serrations which are provided in the plastic either as mouldings or as brass inserts. The serrations 17 on the sleeves and plastic seat inserts can be of different pitches for the individual seal and lid parts.

Wooden toilet seats are now an up-market product and their water stability and hygene characteristics have been greatly improved by using plastic impregnated timbers. In the development of this invention there is a preference for timber which has been impregnated with a thermosetting resin of the kind sold under the "Beetle" trade mark which has been low temperature polymerized, after impregnation, by the use of gamma radiation. Very suitable timer is available from the Lignostone Company Limited of Church, near Accrington in England. With wooden seats, specially designed hinges are required for fitting to the quadrant box mechanism and such a hinge is illustrated in FIG. 5 where the parts 15 rotate on the axle sleeve 6 and are inset into the wood of the seat and held by screws 16. In FIG. 16 the reference 18 is the wooden seat and 19 is a plan projection of the metal hinge.

Figure 7B:
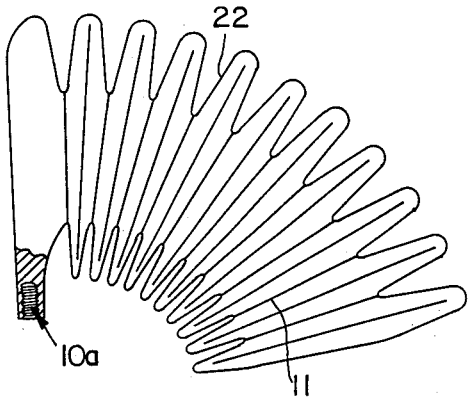
FIG. 7 shows details of the bellows used to operate the lifting mechanism.
Figure 7A:
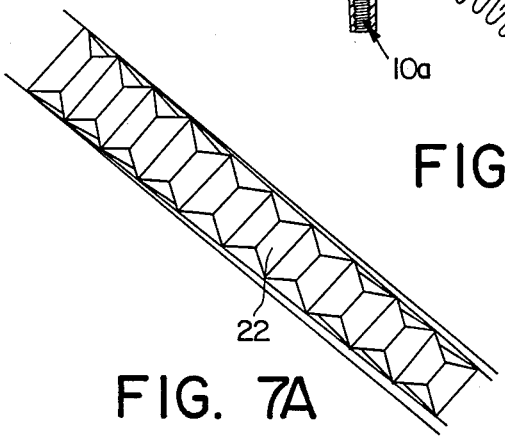

A considerable amount of experiment and design has been put into the manufacture of a suitable rubber or polymer air bag for the actuation of the lever 9, and by way of example a suitable form as shown in FIG. 7 which illustrates the moulded expansion pleats 22 in the bag 11 and indicates the point 10*a* where the metal air pipe enters the bag 11.

The invention can be attached to a toilet bowl in two different modes, depending on whether or not the two quadrant boxes on either side of the systems are activated with air bags and levers in each case. As can be seen from FIG. 2, it is possible to use the left hand quadrant 1 to raise and lower the toilet seat and allow the mechanism in the right hand quadrant to similarly control the movement of the toilet lid.

The air which is needed to activate each quadrant mechanism is readily obtained from neat hemispherical foot bellows which rest on the toilet floor and are connected by PVC tubing to the respective air inlet tubes 10 at each quadrant, or alternatively in large communal areas the system can be severed from a central low pressure air supply via foot valves.

A further important use of the quadrant actuators of the invention is to render the entire action of the water closet fully automatic, as far as the user is concerned, by fitting a quadrant box to the handle of the flushing cistern. In this way the lid and seat of the toilet bowl can be either lowered or lifted by the use of foot bellows, or air valves, and ultimately the bowl can be flushed by a foot switch causing, in the manner already described in relation to the toilet seat and lid mechanism, rotation of the flushing handle axle of the cistern.

With particular reference to FIG. 1A, the quadrant box 32 may be fitted over or in proximity to the valve or handle which controls the flushing device for the cistern. Utilizing either a foot switch connected to a central low pressure air supply or a foot bellows, air may be fed into the quadrant box through tube 10 (FIG. 2) and act upon lever 9 by expanding the pleated rubber bags 11 and 12. The inflation of bag 11 will move the lever past the dotted position near bag 12 to actuate the cistern valve or handle thereby releasing the water held in the cistern and flushing the toilet. Inflation of bag 12 would act to push the lever back to its original position and return the cistern handle or valve to its closed position.

While the mechanism of the present invention has been described and is claimed in relation to its use as a toilet seat and lid mechanism it will be understood that the mechanism has other uses - for example, as an opening and closing mechanism for a tap lever for use with a wash-up basin of the type commonly used in hospitals. In such wash-up basins one moves a lever to open the tap and one may engage the lever in an associated slotted plate to hold the lever in one of different open positions of the tap to regulate the level of constant supply of water from the tap.

Figure 8A:
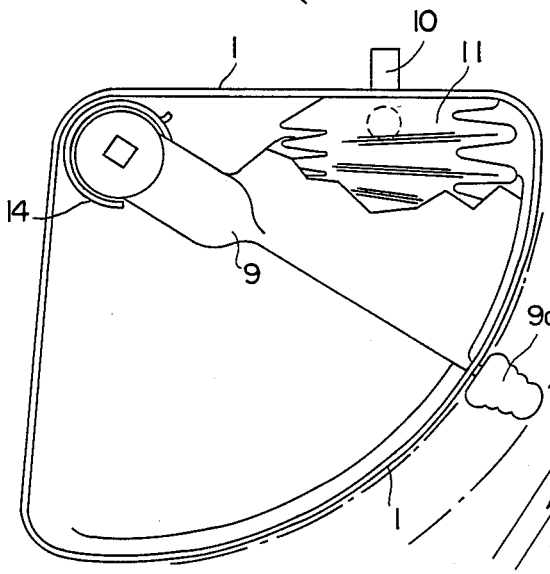
FIG. 8 shows a tap lever for a wash-up basin, the tap lever being within a quadrant box, the tap lever being shown in an open position.
Figure 8B:
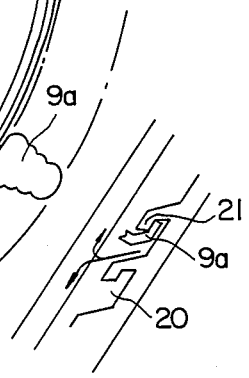

Referring to FIG. 8 of the accompanying drawings the mechanism consists of a quadrant box 1 housing a tap lever 9 having a return spring mounting 14. The free end 9a of the tap lever 9 projects through a slotted portion 20 of the quadrant box 1 such that on depression of the lever 9 to open a water tap the lever may be manually engaged in any one of a number of slots 21 to hold the lever 9 in a depressed position against the spring pressure and the tap open at a particular setting complementary to the lever position.

A bag 11 with an air tube 10 is located within the quadrant box. The bag 11 operates in the same manner as previously described - the air being sourced from a foot actuated air bellows. In use when one has "scrubbed up" or is finished washing one's hands, the foot bellows is actuated to expand the bag 11 which acts to move the lever 9 out of the slot 21 by asserting a force upon lever 9 thereby causing it to disengage from slot 20 and to allow the lever 9 to return under spring action 14 to its original position to close the water tap.

I claim:

1. An apparatus operable to move a toilet seat or toilet lid between raised and lowered positions about an axis of rotation relative to an associated toilet bowl, comprising:

a housing mounted adjacent to the toilet bowl;

an actuating lever disposed within the housing and non-rotatably connected to a hinge carrying the seat or lid, rotation of the actuating lever being effective to cause a corresponding rotation of the seat or lid;

a first inflatable bag disposed within the housing and operable to act on one side of the actuating lever to cause it to rotate the seat or lid in one direction;

a second inflatable bag also disposed within the housing and operable to act on the opposite side of the actuating lever to cause it to rotate the seat or lid in the other direction; and manually-controllable means for supplying fluid under pressure to the first and second bags.

2. A mechanism as claimed in claim 1, further comprising counterbalancing means within the housing mounted adjacent to the toilet bowl, the counterbalancing means being specifically adapted to counterbalance the weight of the toilet seat or lid.

3. An apparatus as claimed in claim 2, wherein said counterbalancing means comprises a coil spring one end of which is operatively connected to the actuating lever and the other end of which is connected to an adjustable tensioning device.

4. An apparatus as claimed in claims 2 or 3, wherein bracket means are provided for mounting the housing onto a conventional toilet bowl, said bracket means being engageable with nuts or bosses used to mount the lid, seat or seat shaft onto the bowl.

5. An apparatus as claimed in claim 1 comprising a central low pressure air supply;

a working fluid consisting of air;

means for connecting the central low pressure air supply to the first and second bags thereby providing a means for the working fluid of air to travel between the central low pressure air supply and the first and second bags;

further comprising a foot valve to control the travel of the working fluid of air between the central low pressure supply and the first and second bags.

6. An apparatus as claimed in claim 1, wherein said hinge comprises a splined surface adapted to engage a corresponding splined surface on a seat or lid.

7. An apparatus as claimed in claim 1, wherein the first and second inflatable bags comprise bellows folded in concertina fashion.

8. An apparaus as in claim 1 wherein a foot bellows supplies fluid under pressure to the first and second bags.

9. An apparatus as in claim 1 comprising:

an additional housing mounted adjacent to the cistern valve or handle operable to open and close the cistern valve or handle;

an actuating lever disposed within the additional housing and nonrotatably connected to the valve or handle of the cistern bowl, rotation of the actuating lever being effective to cause a corresponding rotation of the cistern valve or handle;

a first inflatable bag disposed within the additional housing and operable to act on one side of the actuating lever to cause it to rotate the cistern valve or handle in one direction;

a second inflatable bag also disposed within the additional housing and operable to act on the opposite side of the actuating lever to cause it to rotate the cistern valve in the opposite direction; and manually controllable means for supplying fluid under pressure to the first and second bags.

10. An apparatus as claimed in claim 9 whereby the fluid under pressure is air.

11. An apparatus as claimed in claim 10 whereby the manually controllable means for supplying fluid under pressure to the first and second bags is a foot bellows.

12. An apparatus as described in claim 10 whereby the air causes operation of the actuating means to raise and lower the toilet seat and operation of the actuating means of the additional housing to operate the cistern water valve or handle.

* * * * *